US005824943A

United States Patent [19]

Guhring et al.

[11] Patent Number: 5,824,943

[45] Date of Patent: Oct. 20, 1998

[54] SELF-LOADING RIFLE WITH GAS-PRESSURE LOADING ARRANGEMENT

[75] Inventors: Manfred Guhring; Helmut Weldle, both of Oberndorf, Germany

[73] Assignee: Heckler & Koch GmbH, Germany

[21] Appl. No.: 838,170

[22] Filed: Apr. 16, 1997

[30] Foreign Application Priority Data

Apr. 17, 1996 [DE] Germany ..... 196 15 181.3

[51] Int. Cl.[6] ..... F41B 11/00

[52] U.S. Cl. ..... 89/192

[58] Field of Search ..... 124/64, 65, 66, 124/67, 68; 89/191.01, 191.02, 192, 193

[56] References Cited

U.S. PATENT DOCUMENTS

| | | | |
|---|---|---|---|
| 1,043,534 | 11/1912 | Norman . | |
| 2,895,383 | 7/1959 | Reed | 89/193 |
| 2,983,196 | 5/1961 | Dixon . | |
| 3,018,694 | 1/1962 | Browning . | |
| 3,503,299 | 3/1970 | Joyce et al. | 89/7 |
| 3,592,101 | 7/1971 | Vartanian | 89/193 |
| 3,763,843 | 10/1973 | Fischer et al. | 124/13 A |
| 3,766,903 | 10/1973 | Fischer | 124/15 |
| 3,951,038 | 4/1976 | Van Langenhoven | 89/7 |
| 3,982,468 | 9/1976 | Browning . | |
| 4,174,654 | 11/1979 | Liedke | 89/191 A |
| 4,503,632 | 3/1985 | Cuevas | 42/1 V |
| 4,756,297 | 7/1988 | Sindel | 124/67 |

FOREIGN PATENT DOCUMENTS

| | | |
|---|---|---|
| 721 591 | 4/1942 | Germany . |
| 22 55 287 | 1/1974 | Germany . |

*Primary Examiner*—Charles Jordan
*Assistant Examiner*—Meena Chelliah
*Attorney, Agent, or Firm*—Leydig, Voit & Mayer, Ltd.

[57] ABSTRACT

A gas-pressure loading arrangement for a self-loading rifle includes a gas cylinder fluidly connected to the bore of the rifle barrel and a gas piston received in the gas cylinder to define a gas chamber. The gas piston has piston ring members seated thereon in engagement with the inner surface of the gas cylinder under tension. The piston ring members allow the gas piston to be loosely received in the gas cylinder while preventing gas leakage around the piston. The piston ring members also scrape gas deposits off the inner wall of the gas cylinder during piston movement so that the inner wall remains clean.

16 Claims, 2 Drawing Sheets

SELF-LOADING RIFLE WITH GAS-PRESSURE LOADING ARRANGEMENT

FIELD OF THE INVENTION

This invention relates generally to the weaponry art, and more particularly to a gas-pressure loading arrangement for a self-loading rifle.

BACKGROUND OF THE INVENTION

Self-loading rifles typically use gas-pressure loading arrangements which include a gas cylinder and a gas piston. The gas cylinder has a bore with one end open and the other end closed off by a bottom. The gas piston is slidably received in the gas cylinder and defines a gas chamber as the space between the front end of the piston and the bottom of the gas cylinder. The gas chamber is fluidly connected to the bore of the rifle barrel by a small gas channel which leads to a gas tapping aperture formed in the rifle barrel. The gas piston is movable between a rest position where it establishes the smallest volume of the gas chamber and an end-of-stroke position where it establishes the greatest volume of the gas chamber. The gas piston is coupled to moving parts of the loading mechanism of the rifle so that the movement of the gas piston activates the loading mechanism.

The term "self-loading rifle" as used herein is intended to cover all gas-pressure loading hand firearms, such as submachine guns, assault rifles, rapid-fire rifles or automatic rifles, light machine guns, and universal machine guns, etc., as well as heavier weapons, such as heavy machine guns or air craft machine guns, which also use the gas cylinder/piston arrangement described above.

In a simple construction of the gas cylinder/piston arrangement, the gas cylinder bore is completely closed at one end, and the gas piston is precisely machined to closely fit within the gas cylinder bore. This construction is used, for example, in U.S. carbine 30 M1. When a shot is fired, after the projectile (bullet) passes by the gas tapping aperture in the rifle barrel wall, high pressure combustion gas passes through a gas channel and into the gas chamber and urges the gas piston from its rest position toward its end-of-stroke position. The gas piston in turn acts on the moving parts of the loading mechanism to initiate the loading of the next cartridge to be fired. After the movement cycle is completed, the moving parts of the loading mechanism are pressed against the gas piston by a recoil spring and urge the piston back to its rest position.

After the projectile exits the barrel, the pressure in the barrel is reduced, and the high-pressure gas in the gas chamber that has caused the piston movement expands and flows back through the gas channel into the barrel.

The disadvantages of this simple gas cylinder/piston construction include a relatively high degree of manufacturing precision required for the close fitting of the piston with the gas cylinder bore, and the relatively long time required for the gas in the gas chamber to be discharged after a shot. Another significant disadvantage of that arrangement is that the risk of fouling or clogging increases rapidly with the number of shots fired if the entire mechanism is not frequently and thoroughly cleaned and oiled. This is due to the fact that fouling reduces the clear diameter of the gas channel and hampers the operation of the piston.

These disadvantages are partially remedied by an unconventional gas cylinder/piston arrangement disclosed in DE 721 591, in which the gas piston has a control pin extending forward from its front end. When the gas piston is in the rest position, the control pin penetrates and plugs a gas outlet opening formed in the bottom of the gas cylinder. When the gas piston is moved to its end position, the control pin is pulled out of the outlet opening. The high pressure gas in the gas chamber that has accelerated the piston can then be rapidly discharged through the gas outlet opening. As a result, the amount of gas that flows through the gas channel back to the rifle barrel is significantly reduced, and the soot and other debris deposited in the gas channel is correspondingly reduced.

Another problem associated with the gas cylinder/piston arrangement is related to the quality of sealing between the piston and the cylinder bore. If the gas cylinder and gas piston are made to be relatively long, sufficient sealing may occur around the piston even when the piston is received in the cylinder bore with some play. It is also known to form two deep annular grooves on the circumferential surface of the piston which can scrape off and receive the soot deposited on the inner wall of the gas cylinder bore. The required manufacturing precision is reduced when the accepted tolerances of the gas piston in the gas cylinder bore is increased.

However, fouling of the gas cylinder is correspondingly increased with the increased play. Moreover, the length of the piston must be increased to compensate for the increased play, otherwise the gas tends to escape to the functional mechanisms behind the piston and increase the risk of malfunction of those mechanisms. Increasing the piston length, however, causes difficulties in construction due to the desire to make the total length of the weapon as short as possible, and the constraint on the position of the gas tapping aperture in the barrel prescribed by the internal ballistics of the barrel.

SUMMARY OF THE INVENTION

Accordingly, it is an object of the present invention to provide an improved gas cylinder/piston arrangement for self-loading rifles that more effectively addresses the above-described difficulties than was hitherto possible in the described state of the art.

It is a more particular object of the invention to provide a gas pressure loading arrangement that avoids the requirement of very precise machining operations.

It is a further object of the invention to provide a gas pressure loading arrangement that effectively seals a gas chamber with the use of a gas cylinder/piston combination, while self-cleaning the walls of the cylinder.

The present invention meets these and other objects with a gas-pressure loading arrangement in which a gas piston is relatively loosely fitted within a bore of a gas cylinder. Sealing between the piston and cylinder bore is provided by one or more piston ring members seated on the outer cylindrical surface of the piston. The piston ring members contact the inner wall of the gas cylinder bore under tension and form an effective seal to prevent the gas in the gas chamber from leaking to the rear of the piston. They also maintain the inner wall of the cylinder bore clean by scraping smoke deposits off the inner wall during the back and forth movement of the gas piston in a shooting operation.

Other objects and advantages will become apparent with reference to the following detailed description when taken in conjunction with the drawings in which:

Figure 1:
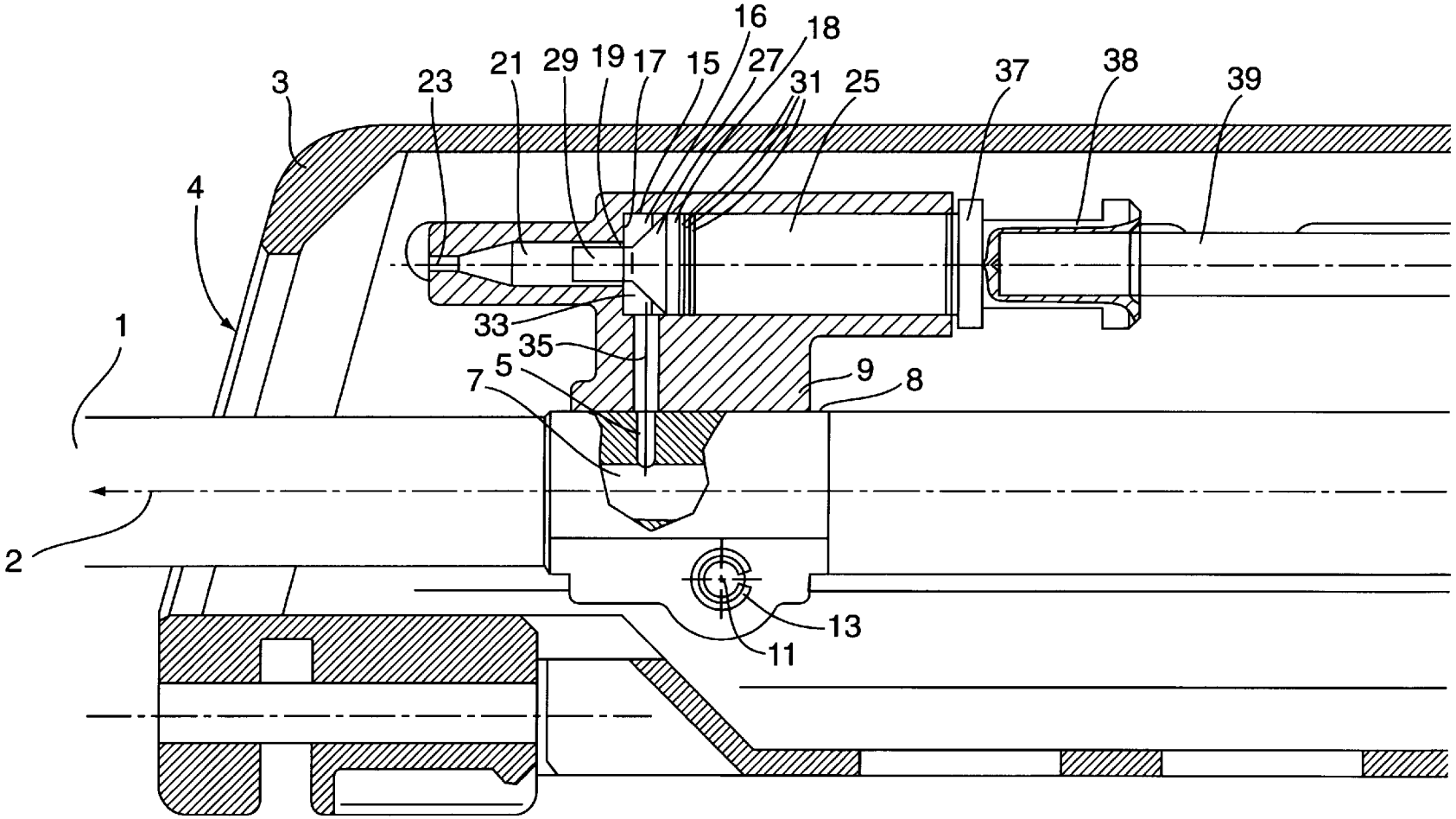
FIG. 1 is a partial cross sectional view of a self-loading rifle having a gas-pressure loading arrangement constructed according to the invention.

While the invention is susceptible of various modifications and alternative constructions, certain illustrated embodiments hereof have been shown in the drawings and will be described below. It should be understood, however, that there is no intention to limit the invention to the specific forms disclosed, but, on the contrary, the intention is to cover all modifications, alternative constructions and equivalents falling within the spirit and scope of the invention as defined by the appended claims.

DETAILED DESCRIPTION OF THE PREFERRED EMBODIMENT

Generally, the present invention relates to a gaspressure loading arrangement for a self-loading rifle. The gas-pressure loading arrangement has a gas cylinder in fluid communication with the bore of the rifle barrel, and a gas piston which is slidably received in the gas cylinder with at least some degree of play (i.e., not closely fitted). At least one piston ring member is seated in a complementary groove formed on the outer cylindrical surface of the piston and is in contacting engagement with the inner wall of the cylinder to form a seal therewith and to scrape smoke deposits and the like from the inner cylinder wall. The piston is also mechanically coupled to the loading mechanism of the rifle. The energy required to operate the self-loading mechanism is provided by high-pressure combustion gas that enters the gas chamber and moves the gas piston and therewith moving parts of the loading mechanism.

Turning now to the drawings, FIG. 1 shows a sectional view of a self-loading rifle with portions thereof removed for clarity. The rifle includes a front portion of a hand guard 3 and a longitudinally extending rifle barrel 1 on which the gas cylinder/piston arrangement is mounted. The arrow 2 in FIG. 1 is oriented in the direction of the muzzle of the rifle and defines a forward direction of the weapon. The position indications used hereinafter, such as "in front," "to the rear," etc., are referenced with respect to this direction.

The hand guard 3 is shown in the form of a perforated housing disposed in surrounding relation, but spaced from, the rifle barrel 1. The hand guard 3 has an front opening 4 which is traversed by the rifle barrel.

As shown in FIG. 1, the rifle barrel 1 has a longitudinal bore 7 and a cylindrical section 8 which lies within the front end section of the hand guard 3. The barrel section disposed forward of the cylindrical section 8 has a diameter less than that of the cylindrical section 8 and that of the barrel section rearward of the cylindrical section. The barrel wall in the zone of the cylindrical section 8 is pierced by a tap bore 5 which extends radially from the longitudinal bore 7.

In the preferred embodiment, a gas cylinder 15 is formed within an add-on piece 9 which is mounted to the cylindrical section 8 of the rifle barrel 1. The gas cylinder 15 comprises a longitudinally extending bore 16 formed in the add-on piece 9 parallel to the rifle barrel. The bore 16 is generally closed at one end by an end wall 17 and open at the opposed end. The cylinder end wall 17 has a vent opening 19 formed therein which is in fluid communication with a gas-expansion chamber 21. The front end of the gas-expansion chamber 21 is tapered and is in fluid communication with an outlet nozzle 23 which is open to the outside of the weapon. The hand guard opening 4 through which the rifle barrel 1 extends is located in front of the outlet nozzle 23. The upper edge of the hand guard opening 4 is disposed at about the height of the outlet nozzle 23. The hand guard inner wall defining the opening 4 is beveled rearward and upward to form a deflecting wall for gas escaping from the outlet nozzle 23.

A gas piston 25 is slidably received in the bore 16 of the gas cylinder 15 to form an enclosed gas chamber 33 between the gas cylinder end wall 17 and a front end 18 of the piston 25. A gas channel 35 in the form of a small bore through the add-on piece 9 connects the gas chamber 33 to the tap bore 5 in the rifle barrel 1. The diameter of the gas channel 35 is preferably greater than the tap bore 5. The diameter of the outlet nozzle 23 is preferably about the same as the tap bore 5.

The rear end portion of the gas piston 25 is formed as a guide section 38 which has a bore extending in the rearward direction. And end of a push rod 39 is received in the bore of the guide section 38. The push rod 39 transfers movement of the gas piston rearward to a breech block, a breech block carrier, or a locking mechanism (not shown) of the weapon as will be understood by those skilled in the art.

In the preferred embodiment illustrated in FIG. 1, the gas piston 25 has an extension formed on its front end 18. The extension includes a truncated conical transition section 27 which couples the piston with a cylindrical control pin 29. The control pin 29 extends forward coaxially with the gas piston 25. The control pin 29 has a diameter which is slightly smaller than the diameter of the vent opening 19 formed in the bottom 17 of the gas cylinder.

FIG. 1 shows the gas piston 25 in a rest position. In this position, the control pin is received in the vent opening 19, with the front end of the truncated conical transition 27 located shortly in front of the vent opening 19. In this position, the control pin 29 plugs the vent opening 19 to prevent leakage of high-pressure gas that has entered the gas chamber 33 from the bore 7 of the rifle barrel. The rest position of the gas piston 25 is established by a stop which is formed by the engagement of a radially-enlarged end flange 37 of the piston 25 with the open end of the gas cylinder 15.

The add-on piece 9 also has a transverse or cross bore 11 formed therein which passes through the add-on piece in a direction perpendicular to shooting direction of the weapon. The cross bore 11 is located under the rifle barrel and intersects at least slightly with the bore which receives the rifle barrel. The rifle barrel preferably has a transverse notch formed thereon at a position where it meets the cross bore 11 and is dimensioned such that the barrel extends slightly into the circumference of the cross bore. A tension sleeve 13, in the form of a springy slit hollow pin, is pressed into the cross bore 11 and bears under tension against the wall of the cross bore and against the notch on the rifle barrel to provide a clamping effect.

In accordance with the invention, the gas piston 25 carries at least one piston ring member on its outer circumferential surface. The preferred embodiment as shown in FIG. 1 has three piston ring members 31 seated in complemental grooves formed in the cylindrical surface of the piston 25. Preferably, the grooves are formed closely adjacent to the piston front end 18 from which the truncated conical transition 27 extends. The three piston ring members 31 are positioned parallel with and adjacent to each other to form a band arrangement.

For providing sealing engagement with the inner cylinder wall, the piston ring members 31 contact the inner wall of the gas cylinder bore under tension. Each piston ring member is opened at a split joint (see FIG. 2) to allow ready assemblage onto the gas piston 25. The ring members 31 are also preferably mounted on the gas piston with angular offsets, i.e., they are rotated with respect to each other, so that their split joints are not aligned. In this way, it is ensured that the entire perimeter of the gas piston 25 is sealed.

Figure 2:
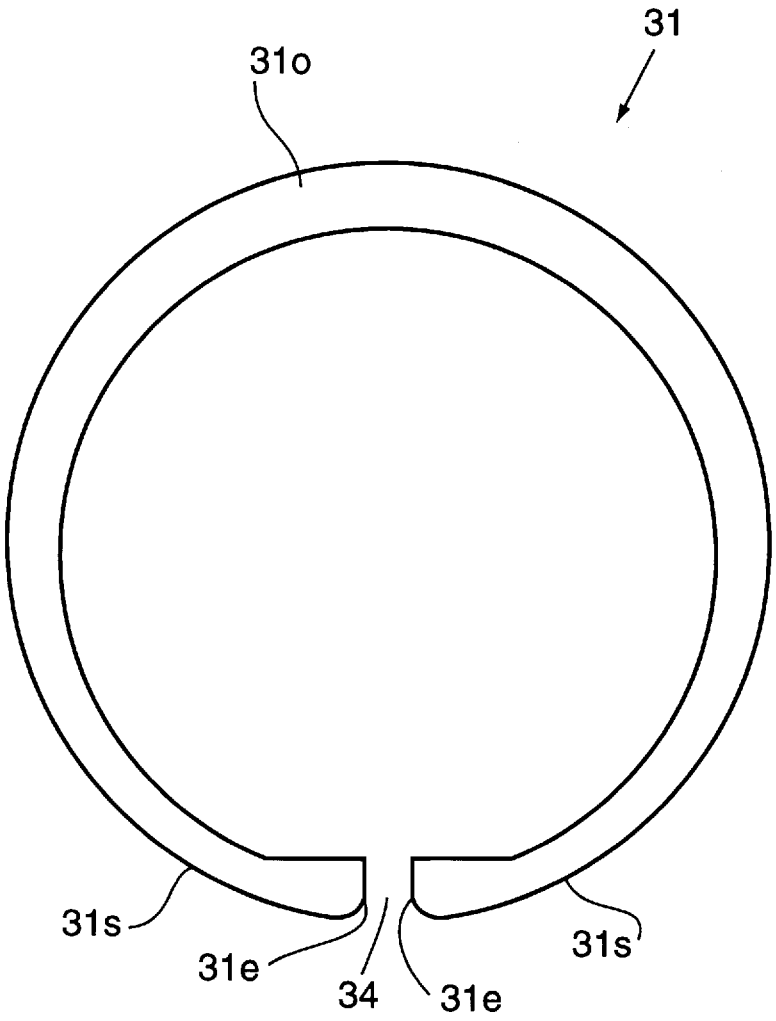
FIG. 2 is an enlarged elevational view of a piston ring member used in the gas-pressure loading arrangement of FIG. 1.

FIG. 2 shows one of the piston ring members 31 in an enlarged view. The piston ring member 31 is in the form of an essentially annular spring-steel yoke with a rectangular cross section. Preferably, the spring-steel yoke is open at a split joint 34. The width of the piston ring member 31 is not a constant but rather is widest in the section 31*o* opposite to the split joint 34 and narrowest on the side sections 31*s* adjacent the split joint 34, and is thickened at the two ends 31*e* flanking the split joint 34.

Turning back to FIG. 1, when a shot is fired, the projectile (bullet) is propelled in the direction indicated by the arrow 2. Immediately after the projectile passes the tap bore 5 on the barrel wall, high pressure combustion gas flows through the tap bore 5 and the gas channel 35 into the gas chamber 33. The gas acts on the gas piston 25 and starts its movement toward its end-of-stroke position. Shortly before the gas piston 25 reaches its end-of-stroke position, the control pin 29 is completely withdrawn from the vent opening 19 in the bottom wall of the gas cylinder so that the vent opening is no longer sealed. The high pressure gas present in the gas chamber 33 and possibly still flowing into the gas chamber through the gas channel 35 can then escape through the vent opening 19.

It is a feature of the present invention to use one or more piston ring members 31 seated on the gas piston 25 to provide a sealed coupling between the gas piston and the gas cylinder 15. The contact between the inner wall surface of the gas cylinder and the piston ring members, instead of the cylindrical surface of the piston 25, provides the sealing. This arrangement achieves the sealing capability of a close-fitting piston/cylinder arrangement used in the prior art, but without the need of high manufacturing precision to ensure a close fit.

Another advantage associated with the use of piston ring members 31 is that there are no thermal problems caused by the frictional engagement between the piston 25 and the gas cylinder 15. This is because a piston ring member 31 under pressure can resiliently yield in the radial direction while maintaining sealing contact with the inner wall of the gas cylinder 15.

In addition to providing an effective and reliable seal, each of the piston ring members 31 also functions as a scraper. After each shot, as the piston returns from its end-of-stroke position to the front rest position, the piston ring members 31 scrape off the impurities that have been deposited on the inner wall of the gas cylinder and move the impurities forward. These loose residues are picked up during each shot by the highly turbulent combustion gas in the gas chamber 33 and discharged together with the gas through the ejection nozzle 23 and through the transverse bore 35. Even with the stress on the piston ring edges in the scraping operation, the piston ring members 31 remain undamaged over a large number of shots. Furthermore, as a safety measure, the piston ring members 31 can be replaced during a routine inspection of the weapon.

Because the piston ring members 31 virtually completely seal off the gap between the gas piston 25 and the gas cylinder 15, gas leakage to the rear is avoided. As a result, the amount of gas that is required to effect the piston movement is reduced, with the corresponding reduction of impurities deposited by the gas. The risk of fouling of the functional elements of the rifle is also substantially eliminated. Accordingly, the gas cylinder/piston arrangement of the invention requires less maintenance but functions better as compared to the prior art arrangements. Because the fouling is significantly reduced, the gas cylinder/piston arrangement can remain operative for a long time without cleaning or oiling.

Even though a single piston ring member may still provide satisfactory results, it is preferred to use several piston ring members to further improve the sealing and cleaning functions. With multiple piston ring members, the small amount of deposits that is not removed by the foremost ring member may be scraped off by the following ring members and received between the piston ring members without impairing their operation.

The piston ring members may be distributed over the entire length of the gas piston. However, in the preferred embodiment as described above, they are closely spaced from each other to form a band near the front end 18 of the gas piston 25. The spacing between the piston ring members 31 is preferably so determined that if the ring members vibrate during the piston movement, their individual rattle marks cover one another so that the deposits are removed without substantial remainder. The piston ring members 31 preferably engage the inner wall of the gas cylinder 15 under bias tension. The tensioned engagement prevent forms a close contact to reduce smoke deposits accumulated on the wall and ensures effective sealing. Placing the ring members 31 near the front end of the piston 25 is advantageous in that the region of the cylinder bore in which the piston is present is always kept clean by the piston ring arrangement. Even with the delivery of several thousand shots, the deposits formed on the wall of the gas cylinder 15 would not be build up enough to hinder the movement of the piston.

In the preferred embodiment, the risk of fouling is further reduced by the use of the control pin 29 to control the venting of gas in the gas chamber 33. The advantage of this arrangement is that when the piston is sufficiently displaced, the relatively large vent opening 19 is opened and the gas in the gas chamber 33 can be discharged rapidly. The inner wall surface of the gas cylinder 15 is therefore minimally exposed to the powdery gas. Furthermore, the gas discharge occurs at the point of the gas chamber 33 that is farthest from the piston 25 so that the likelihood of the gas flowing around the piston and leaving deposits is significantly reduced.

The truncated conical transition section 27 on the gas piston 25 not only improves the strength of the control pin 29 but also guides the gas to be charged through the gas chamber 33.

As described above, in the preferred embodiment the vent opening 19 in the cylinder end wall 17 is not connected directly to the ambient air but leads to an expansion chamber 21 which in turn leads to an outlet nozzle 23 which opens to the ambient air. This arrangement prevents the emergence of a sharp jet of hot gas which may irritate the user and foul exterior parts of the rifle. The gas exiting the expansion chamber through the outlet nozzle 23 has a relatively low pressure and forms a rather soft and diffused jet. The jet further mixes with the cooler ambient air under the hand guard 3 of the weapon. Thus, if the discharged gas somehow reaches the hand of the user, it is typically at a relatively low temperature.

Although the control pin arrangement is preferred, other alternative arrangements may also be used. For instance, the gas in the gas chamber can simply be discharged through the gas channel 35 back to the rifle barrel bore. It is also possible to provide a gas outlet opening in the inner wall of the gas cylinder bore that is uncovered by the piston when the piston is in its end-of-stroke position. As another alternative, a gas outlet opening that is open to the gas chamber all the time could be formed in the gas cylinder. In such a case, however, an adjusting arrangement would be required to prevent excess gas from escaping, otherwise the operation of the gas cylinder/piston may become unreliable. As fouling increases, the adjusting arrangement may have to be readjusted.

The add-on piece 9 on which the gas cylinder is formed is slid onto the cylindrical section 8 of the rifle barrel 1 and secured thereon by means of the tension sleeve pressed into the cross hole 11 in the add-on piece. The tension sleeve 13 is a longitudinally slit hollow tube formed of spring steel. The relative position between the cross bore 13 and the rifle barrel 1 is such that the barrel extends slightly into the cross bore. The part of the cross bore 13 opposite to the barrel is correspondingly recessed. When the tension sleeve 13 is pressed into the cross bore 13, its axis is not straight but rather slightly curved. This arrangement increases the clamping effect provided by the tension sleeve. The removal and installation of the tension sleeve 13 can be done simply with a hammer and a punch and does not require special skill. The add-on piece 9 can therefore be easily detached from the rifle barrel 1 for cleaning and inspection.

Even though the slide-on arrangement described above is preferred, in an alternative embodiment the add-on piece may be mounted on the barrel by the known thermal shrinking method. The shrunk mounting is reliable in holding the add-on piece on the barrel. A shrunk-on add-on piece, however, cannot be easily removed and reinstalled for inspection or cleaning.

It should now become appreciated that a gas pressure loading arrangement meeting the aforestated objectives has been described. The arrangement utilizes one or more piston ring members seated on the gas piston to provide a sealing engagement with the gas cylinder, thereby eliminating the need to precisely control the diameter of the piston to closely fit the gas cylinder. In the preferred embodiment, a control pin disposed on the gas piston cooperates with an aperture located in the bottom of the gas cylinder to provide controlled discharge of gas in the gas chamber after the loading mechanism has been activated. The gas cylinder is formed as part of an add-on piece which can be easily slid onto the rifle barrel and secured thereon with a tension sleeve through a cross bore formed in the add-on piece.

What is claimed is:

1. A combustion gas pressure activated self-loading rifle comprising:

a rifle barrel having a longitudinally extending bore;

a gas cylinder having an inner wall defining a bore, a first end and a second end, and an end wall at least partially closing off the first end;

a gas piston received in the bore of the gas cylinder to form a gas chamber between a first end of the gas piston and the end wall of the gas cylinder, the gas piston being slidable in the gas cylinder between a rest position which establishes a reduced volume of the gas chamber and a end-of-stroke position which establishes an increased volume of the gas chamber, the gas chamber in fluid communication with the bore of the rifle barrel by a gas channel; and at least one split piston ring member seated on an outer circumferential surface of the gas piston in sliding engagement with the inner wall of the gas cylinder such that said piston ring member scrapes off combustion gas deposits from the inner wall of the gas cylinder.

2. The invention as in claim 1 wherein the rifle includes three piston ring members seated on the outer circumferential surface of the gas piston in sliding engagement with the inner wall of the gas cylinder.

3. The invention as in claim 2 wherein the three piston ring members are seated adjacent and parallel to each other to form a band.

4. The invention as in claim 3 wherein each of the piston ring members has a split joint, and wherein the split joints of the piston ring members seated on the gas piston are angularly offset from each other.

5. The invention as in claim 1 wherein the piston ring member bears against the inner wall of the gas cylinder under a bias tension.

6. The invention as in claim 1 wherein the piston ring member is disposed adjacent the front end of the gas piston.

7. The invention as in claim 1 wherein the gas piston further comprises a control pin depending from the front end, the control pin extending through a vent opening formed in the gas cylinder end wall when the gas piston is in the rest position and withdrawn from the vent opening when the gas piston is in the end-of-stroke position.

8. The invention as in claim 7 further comprising an expansion chamber and an outlet nozzle, the vent opening being in communication with the expansion chamber and with the outlet nozzle to permit gas to escape therethrough to the ambient air.

9. The invention as in claim 7 wherein the control pin is connected to the front end of the piston by a truncated conical transition section.

10. The invention as in claim 1 further comprising an add-on piece wherein the gas cylinder and gas channel are formed therewithin, the add-on piece being slidably mounted onto the rifle barrel at a selected position wherein the gas channel is in alignment with a gas tap bore formed in the rifle barrel, the add-on piece further including a cross bore formed therein which transverses through the add-on piece in a direction transverse to the rifle barrel and at least partially intersecting the rifle barrel, the add-on piece further having a tension sleeve seated in the cross bore and contacting the rifle barrel under tension.

11. The invention as in claim 10 wherein the tension sleeve is curved under contact pressure against the rifle barrel.

12. A self-loading rifle comprising:

a rifle barrel having a longitudinally extending bore;

a gas cylinder having an inner wall defining a bore, a first end and a second end, and an end wall at least partially closing off the first end;

a gas piston received in the bore of the gas cylinder to form a gas chamber between a first end of the gas piston and the end wall of the gas cylinder, the gas piston being slidable in the gas cylinder between a rest position which establishes a reduced volume of the gas chamber and a end-of-stroke position which establishes an increased volume of the gas chamber, the gas chamber in fluid communication with the bore of the rifle barrel by a gas channel; and at least one piston ring member seated on an outer circumferential surface of the gas piston in sliding engagement with the enter wall of the gas cylinder, the gas piston further comprising a control pin depending from the front end, the control pin extending through a vent opening formed in the gas cylinder end wall when the gas piston is in the rest position and withdrawn from the vent opening when the gas piston is in the end-of-stroke position.

13. The invention as in claim 12 further comprising an expansion chamber and an outlet nozzle, the vent opening being in communication with the expansion chamber and with the outlet nozzle to permit gas to escape therethrough to the ambient air.

14. The invention as in claim 12 wherein the control pin is connected to the front end of the piston by a truncated conical transition section.

15. A self-loading rifle comprising:

a rifle barrel having a longitudinally extending bore;

a gas cylinder having an inner wall defining a bore, a first end and a second end, and an end wall at least partially closing off the first end;

a gas piston received in the bore of the gas cylinder to form a gas chamber between a first end of the gas piston and the end wall of the gas cylinder, the gas piston being slidable in the gas cylinder between a rest position which establishes a reduced volume of the gas chamber and a end-of-stroke position which establishes an increased volume of the gas chamber, the gas chamber in fluid communication with the bore of the rifle barrel by a gas channel;

at least one piston ring member seated on an outer circumferential surface of the gas piston in sliding engagement with the inner wall of the gas cylinder; and an add-on piece wherein the gas cylinder and gas channel are formed therewithin, the add-on piece being slidably mounted onto the rifle barrel at a selected position wherein the gas channel is in alignment with a gas tap bore formed in the rifle barrel, the add-on piece further including a cross bore formed therein which transverses through the add-on piece in a direction transverse to the rifle barrel and at least partially intersecting the rifle barrel, the add-on piece further having a tension sleeve seated in the cross bore and contacting the rifle barrel under tension.

16. The invention as in claim 15 wherein the tension sleeve is curved under contact pressure against the rifle barrel.

* * * * *